US006986168B2

(12) United States Patent
Abelman et al.

(10) Patent No.: US 6,986,168 B2
(45) Date of Patent: Jan. 17, 2006

(54) PROTECTIVE HEADGEAR

(75) Inventors: Michael Abelman, Sebastian, FL (US); Dominick Cabal, Melbourne, FL (US); Randy Vernon, West Melbourne, FL (US)

(73) Assignee: Macho Products, Inc., Sebastian, FL (US)

( * ) Notice: Subject to any disclaimer, the term of this patent is extended or adjusted under 35 U.S.C. 154(b) by 53 days.

(21) Appl. No.: 10/771,608

(22) Filed: Feb. 4, 2004

(65) Prior Publication Data

US 2004/0154080 A1 Aug. 12, 2004

Related U.S. Application Data

(60) Provisional application No. 60/444,701, filed on Feb. 5, 2003.

(51) Int. Cl.
*A63B 71/10* (2006.01)

(52) U.S. Cl. ..... 2/425; 2/412; 2/414; 2/423

(58) Field of Classification Search ..... 2/411, 2/412, 414, 410, 425, 423, 424
See application file for complete search history.

(56) References Cited

U.S. PATENT DOCUMENTS

| | | | | | |
|---|---|---|---|---|---|
| 1,637,692 | A | * | 8/1927 | Fitzpatrick et al. | 2/423 |
| 1,714,275 | A | * | 5/1929 | Mullins | 2/425 |
| 2,777,127 | A | * | 1/1957 | Marietta | 2/424 |
| 2,926,356 | A | | 3/1960 | Taylor | |
| 3,242,500 | A | | 3/1966 | Derr | |
| 3,527,461 | A | * | 9/1970 | Prater | 2/424 |
| 3,616,463 | A | | 11/1971 | Theodore et al. | |
| 4,038,700 | A | | 8/1977 | Györy | |
| 4,282,610 | A | * | 8/1981 | Steigerwald et al. | 2/414 |
| 4,446,576 | A | * | 5/1984 | Hisataka | 2/425 |
| 4,706,305 | A | * | 11/1987 | Cho | 2/425 |
| 5,177,815 | A | | 1/1993 | Andjuar | |
| 5,351,342 | A | | 10/1994 | Garneau | |
| 5,392,468 | A | * | 2/1995 | Leddick, III | 2/424 |
| 5,713,082 | A | | 2/1998 | Bassette | |
| 5,950,244 | A | | 9/1999 | Fournier et al. | |
| 6,159,324 | A | | 12/2000 | Watters et al. | |
| 6,272,692 | B1 | | 8/2001 | Abraham | |
| 6,282,724 | B1 | * | 9/2001 | Abraham et al. | 2/412 |
| 6,389,607 | B1 | | 5/2002 | Wood | |
| 6,427,253 | B1 | | 8/2002 | Penny | |

FOREIGN PATENT DOCUMENTS

DE 3632525 A1 * 3/1988

* cited by examiner

*Primary Examiner*—Rodney M. Lindsey
(74) *Attorney, Agent, or Firm*—Robert L. Wolter, Esq.; Beusse Browniee Wolter Mora & Maire, P.A.

(57) ABSTRACT

A protective headgear device comprises a circumferential member composed of a foam material, having an interior that generally conforms to the shape of one's head. The circumferential member has a first opening for viewing and a second open through which the neck of the user extends. A plurality of internal pads is secured to an interior surface of the circumferential member, and the pads are spaced apart from one another, to protect predetermined sensitive areas of the head. Impact plates are affixed to the interior surface of circumferential member, and each impact plate is disposed between the circumferential member and a corresponding internal pad. The impact plates supplement the protection of the internal pads and the circumferential member for absorbing trauma forces applied to the headgear.

11 Claims, 4 Drawing Sheets

PROTECTIVE HEADGEAR

This application claims priority of Provisional Patent Application Ser. No. 60/444,701, filed on Feb. 5, 2003.

FIELD OF THE INVENTION

The field of this invention pertains to protective headgear used in connection with contact sports such as boxing and martial arts, and self-defense training, which may involve trauma forces to the head. The invention relates more specifically to such protective headgear fabricated from foam material.

BACKGROUND OF THE INVENTION

Participants in contact sports, or self-defense training often require protective wear to minimize injury. Helmets or protective headgear are used in various sports such as football, baseball, ice hockey, field hockey, martial arts, boxing or self-defense training. Protective headgear used in boxing and martial arts may be fabricated from a resilient foam material such as polyurethane foam, which is cut and/or molded to cover sensitive portions of the head for protection. Sections of the headgear may be perforated, or contain openings for ventilation, viewing or hearing. The foam absorbs energy from blows to the head, and is lightweight to minimize stress to the neck and shoulders during use. However these headgear devices may not provide sufficient protection to certain sensitive areas of the head without adding any measurable weight or size to the headgear.

SUMMARY OF THE INVENTION

The present invention is for a protective headgear device comprising a circumferential member composed of a foam material, having an interior that generally conforms to the shape of one's head. The circumferential member has a first opening for viewing and a second open through which the neck of the user extends. A plurality of pads (also referred to as "internal pads") are secured to an interior surface of the circumferential member, and are spaced apart from one another, to protect predetermined sensitive areas of the head. The internal pads absorb trauma forces applied to the headgear. In addition, impact plates, or inserts, are affixed to the interior surface of outer shell, and each impact plate is disposed between the circumferential member and a corresponding internal pad. The impact plates supplement the protection of the internal pads and outer shell for absorbing trauma forces applied to the headgear.

A method for the fabrication of a protective headgear device is also described herein as comprising the steps of forming a foam material to define a resilient and flexible circumferential member generally conforming to the shape of a user's head, positioning a plurality of impact plates at predetermined locations on an interior surface of the circumferential member; affixing the impact plates to the interior surface of the circumferential member at the predetermined locations, positioning a plurality of internal pads along the interior surface of the outer shell at the predetermined locations; and, affixing each internal pad to the interior surface of the circumferential member over a corresponding impact plate.

BRIEF DESCRIPTION OF THE DRAWINGS

The features and advantages of the present invention will become apparent from the following detailed description of the invention when read with the accompanying drawings.

DETAILED DESCRIPTION OF THE DRAWINGS

Figure 1:
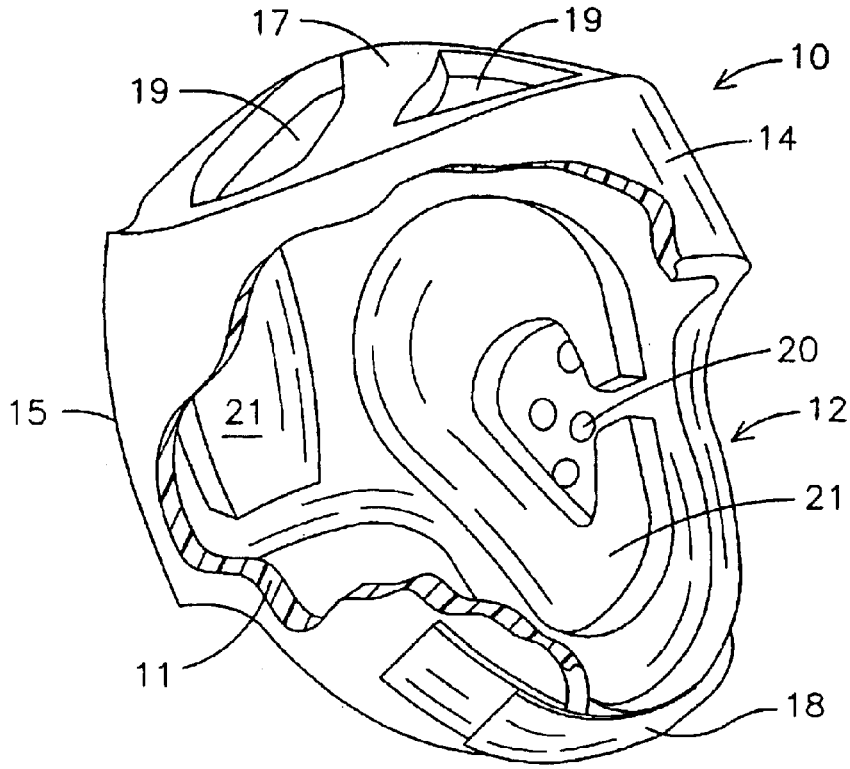
FIG. 1 is a perspective view of the interior of a protective headgear device.
Figure 2:
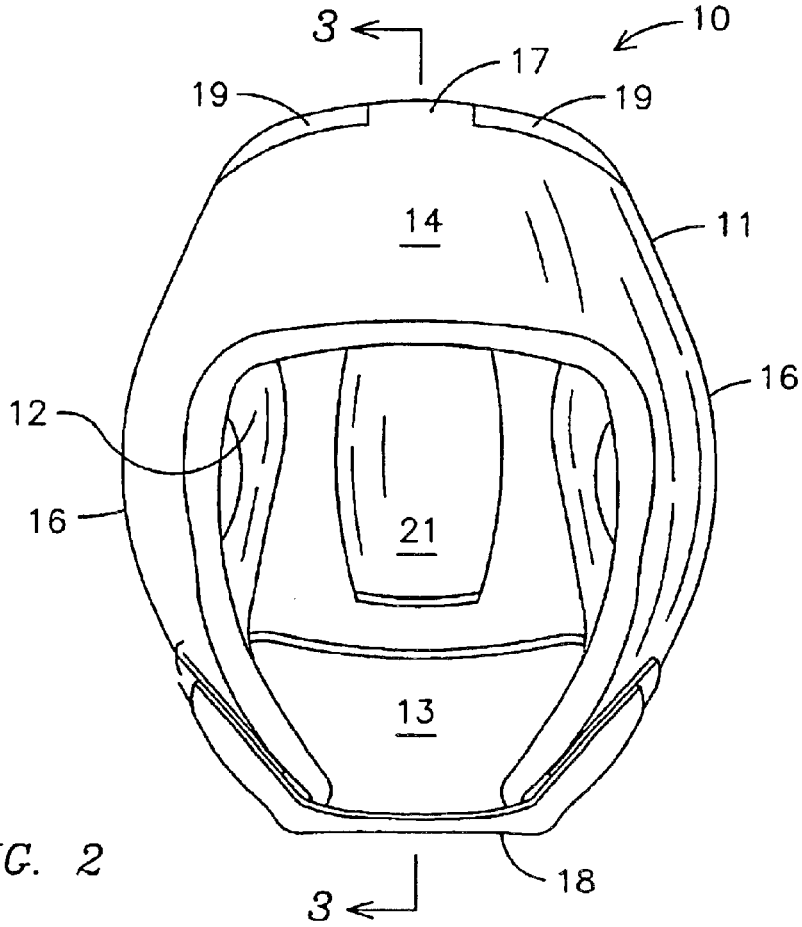
FIG. 2 is a front elevational view of a protective headgear device.

An exemplary embodiment of the present invention for a protective headgear 10 is shown in FIGS. 1 and 2. The protective headgear device 10 includes a circumferential member 11, or outer shell, that generally conforms to the shape of one's head and covering portions of one's head for protection. The circumferential member 11 includes a front section 14 for covering the forehead, a back section 15 for covering the back of the head, two side sections 16 for covering the ears, temples, jaws and side of the head and a top section 17. The sections 14, 15, 16 and 17 are arranged to form a first opening 12 through which a user is capable of viewing, and a second opening 13 through which a user's neck extends.

In addition, sections of the headgear 10 may be perforated for ventilation and hearing. For example, openings 19 at the top section 17 provide ventilation for a user. Apertures 20 adjacent one's ear on the side sections 16 also provides for ventilation, and assist in hearing.

A chinstrap 18 is secured to each of the side sections 16, and extends under a user's chin to secure the device 10 on the head.

The circumferential member 11 is fabricated from a suitable foam material that is conformable and resilient, capable of absorbing energy and forces when contacted and deformed by a strike or blow from another person. In an exemplary embodiment, the foam material is a polyvinylnitrile closed cell foam product that is die-cut according to predetermined specifications for forming the various sections 14–17, apertures 20 and openings 12, 13 and 19. The circumferential member 11 has a substantially uniform thickness that may range from about 0.375 inches to about 0.50 inches, depending on the size of the headgear 10.

The circumferential member 11, and supplemental parts including the internal pads 21, and impact plates 22, is encased within a tough pliable coating, preferably comprising a polyvinyl chloride. Known dipping or painting processes are used to apply the coating.

Figure 4:
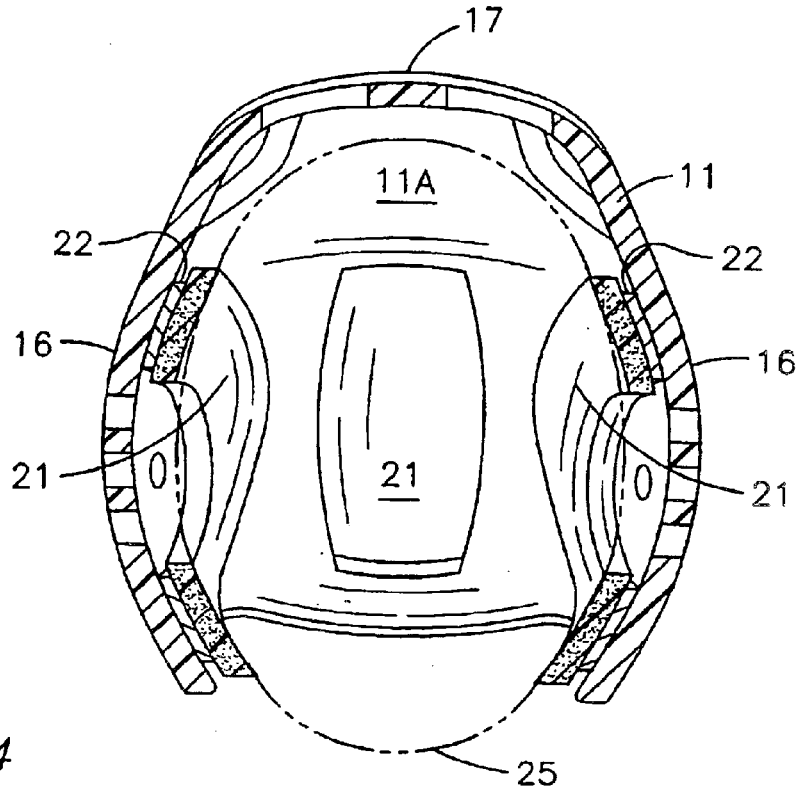
FIG. 4 is a sectional view of the protective headgear taken along line 4—4 in FIG. 3.

Protection to certain crucial parts of the head is supplemented by the addition of internal pads 21 secured to an interior surface of the circumferential member 11. As shown in FIGS. 2 and 4, the internal pads 21 are spaced apart along the internal surface of the circumferential member 11 to protect predetermined areas of the head from trauma applied to the head 25 and headgear 10. The internal pads 21 are placed on the headgear 10 so the internal pads 21 are positioned adjacent ears (not shown) of the user and the back of the head.

The internal pads 14 are preferably constructed of the same foam material used to fabricated the circumferential member 11, and are the substantially the same thickness as the circumferential member 11. The invention is not limited by these identified dimensions, which may vary according to the size of the headgear 10.

Figure 3:
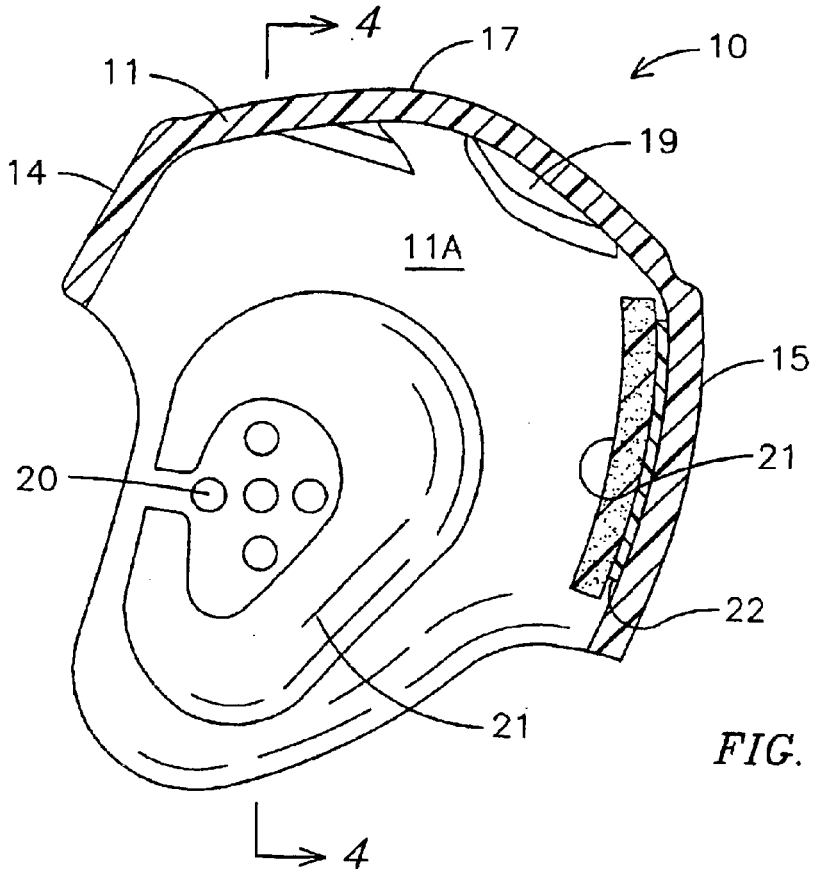
FIG. 3 is a sectional view of the protective headgear taken along line 3—3 in FIG. 2.

As shown in FIGS. 3 and 4, impact plates 22 are secured to the interior surface of the circumferential member 11 and disposed between the internal pads 21 and the interior surface 11A of the circumferential member 11. The impact plates 22 have an outer edge 22A corresponding to a predetermined sensitive area on a user's head, and which are coextensive with the outer edges 21A of the internal pads 21. With respect to FIG. 5, the impact plates 22 and internal pads 21 are generally shaped to protect the outer ear of a user, but do not cover the apertures 20 on the headgear 10.

The impact plates 22 are comprised of a rigid plastic material that also has sufficient flexibility or resiliency to conform to the configuration of the interior surface of the circumferential member 11 and upon impact from a blow to the headgear 10. In an exemplary embodiment, the impact plates 22 are constructed from an injection molding process using acrylnitrile butadiene styrene plastic. The impact plates 22 are preferably about ⅛ inch thick, which provides sufficient rigidity and flexibility to absorb and/or disperse force applied by a blow to the head. The impact plates 22 are preferably affixed to the interior surface 11A of the circumferential member 11 using contact cement.

Figure 6:
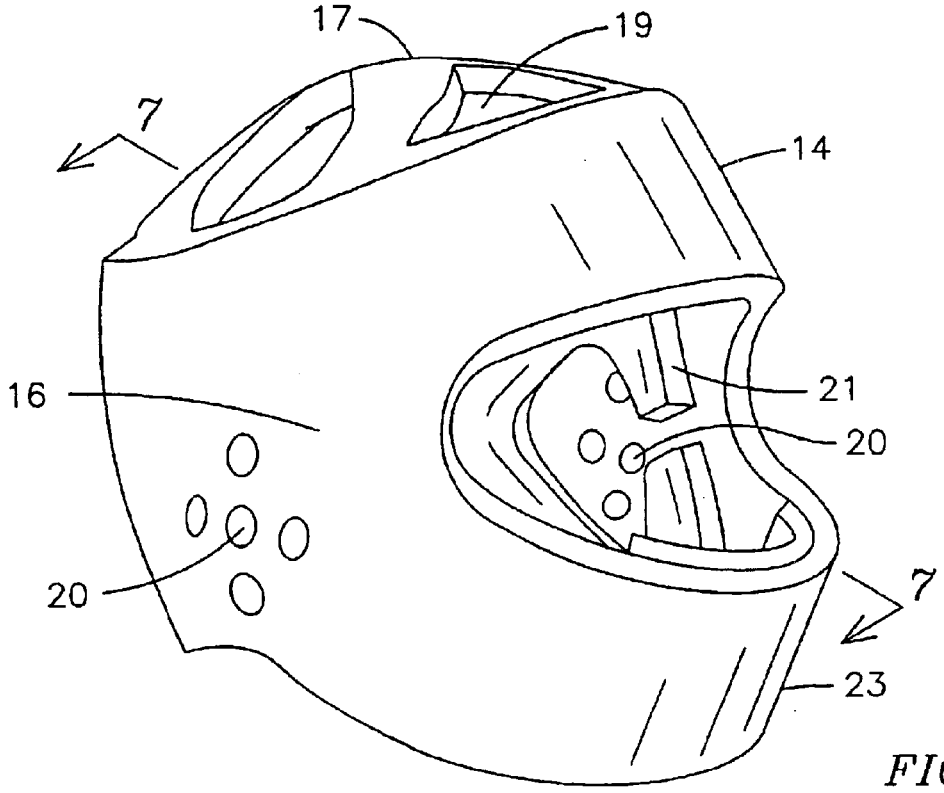
FIG. 6 is an alternative embodiment of the invention having an integrated chin pad.
Figure 7:
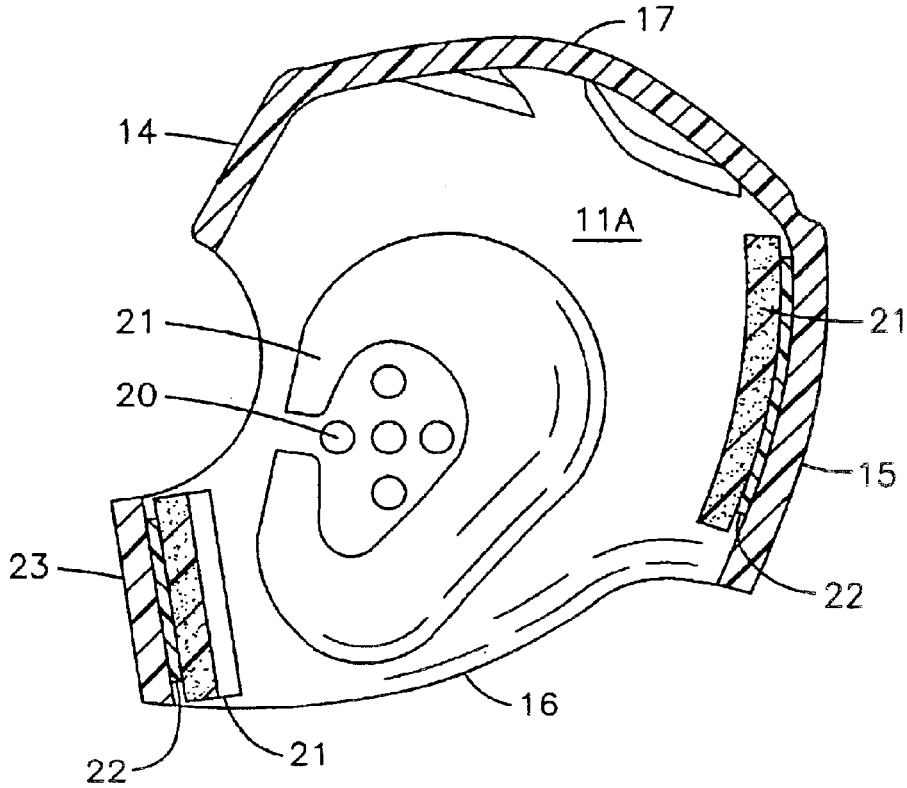
FIG. 7 is a sectional view of the taken along line 7—7 in FIG. 6.

An alternative exemplary embodiment is shown in FIGS. 6 and 7, and includes a chin protector 23 integrally formed with the circumferential member 11. The chin protector 23 includes a foam section integrally formed with the side sections 16 of the circumferential member 11. An impact plate 22 and internal pad 21 are affixed to an interior surface of the chin protector 23 so that the internal pad 22 is positioned adjacent the chin of a user wearing the headgear 10.

Figure 5:
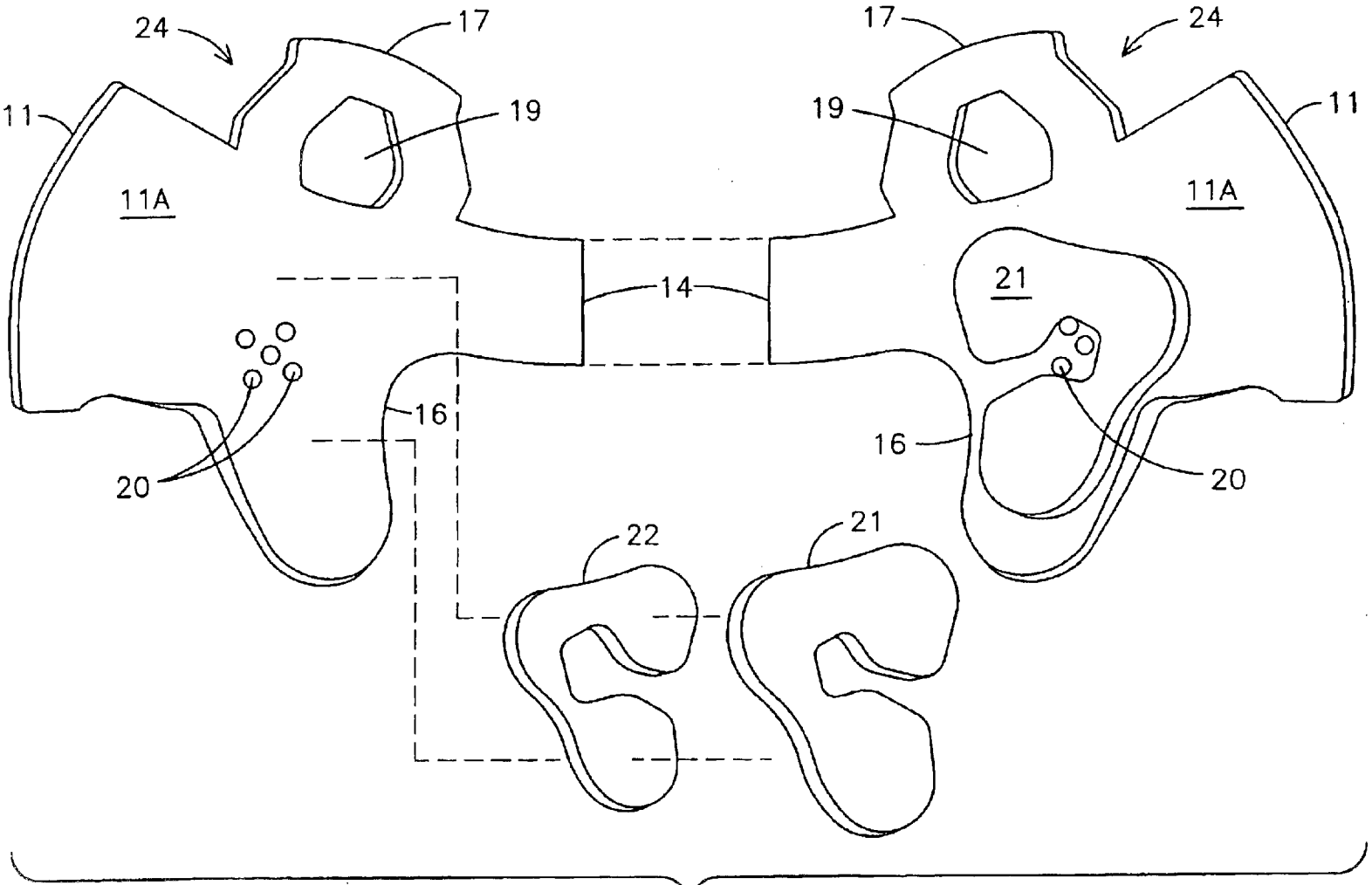
FIG. 5 is an exploded view of an internal pad the protective headgear device.

The method of fabrication of the protective headgear 10, as shown in FIG. 5, comprises the steps of providing a foam material die cut and/or molded to incorporate the sections 14–17 and apertures 20 of the protective headgear 10. A substantially flat piece of the foam material is cut into the two half portions 24 of the headgear 10 whereby the half portions 24 include a side section 16, and respective portions of the front section 14, back section 15 and top section 17. The internal pads 21, fabricated from the same foam material, are provided with the impact plates 22, which are fabricated from injection molding techniques known to those skilled in the art.

Once all the pieces are produced from die-cut and/or injection molding, the impact plates 22 are affixed to the interior surface of the circumferential member 11 at those predetermined areas designated to protect the head. In a preferred embodiment, the impact plates 22 and internal pads 21 for protecting the ears are affixed to the side sections 16. The internal pads 21 are secured to the interior surface 11A circumferential member 11 over the impact plates 22, encapsulating the impact plates 22 within the protective headgear 10, between the circumferential member 11 and the internal pads 21.

The two half portions 24 are then affixed to one another using known adhesives preferably beginning along the back section 15, forming a seam (not shown), which is covered with a vinyl tape. An impact plate 22 and internal pad are then affixed to the back section 15 of the headgear. Subsequently, the top section 17 and front section 14, of the two halves 24 are affixed to one another forming the circumferential member 11. The entire protective headgear 10 may then be dipped or brushed with a colored polyvinyl chloride. The chinstrap 18 may then be affixed to side sections 16. Prior to the dipping process, the seam (not shown) formed along the top section 17 and front section is preferably covered with tape to protect adhesive from the polyvinyl chloride coating.

While the invention has been described in what is presently considered to be a preferred embodiment, many variations and modifications will become apparent to those skilled in the art. Accordingly, it is intended that the invention not be limited to the specific illustrated embodiment, but be interpreted within the full spirit and scope of the appended claims.

What is claimed is:

1. A protective headgear device, comprising:

(a) a circumferential member composed of a foam material generally conforming to the shape of a user's head and having an interior surface;

(b) a plurality of internal pads, spaced apart from one another, and secured to the interior surface of the circumferential member adjacent to predetermined areas of the head, and the internal pads absorb or disperse trauma forces applied to the headgear; and, (c) a plurality of impact plates affixed to the interior surface of circumferential member, and each impact plate is disposed between the circumferential member and a corresponding internal pad, and the impact plates absorb or disperse trauma force applied to the headgear.

2. The device of claim 1 wherein each impact plate has a circumferential edge defining a shape of the impact plate and each internal pad associated with an impact plate has a circumferential edge coextensive with the edge of the impact plate.

3. The device of claim 1 wherein said device circumferential member and internal pads are covered with a polyvinyl coating material.

4. The device of claim 1 wherein said impact plates include a first impact plate and a second impact plate, and the first and second impact plates are each positioned on the circumferential member for protection of a user's ears.

5. The device of claim 1 wherein an impact plate is positioned on the interior surface of the circumferential member for protection of the back of a user's head.

6. The device of claim 1 wherein the circumferential member comprises at least one aperture through each side of the circumferential member adjacent an ear of the user and the impact plates include a first impact plate and a second impact plate on the interior surface of the circumferential member and each first and second plate generally following an outline of an ear and extending around said aperture, and substantially not covering the aperture.

7. A protective headgear device for protecting a user's head from trauma forces, comprising:

(a) a circumferential member composed of a foam material generally conforming to the shape of a user's head and having an interior surface, and the circumferential member having an imperforate first section for covering a forehead, and an imperforate back section for covering a back of the head, two side sections, integrally connected to the back section and front section, for covering ears of the user, and the side sections having at least one aperture;

(b) a plurality of internal pads, spaced apart from one another, and secured to the interior surface of the circumferential member adjacent to predetermined areas of the head, and the internal pads absorb or disperse trauma forces applied to the headgear, (c) a plurality of impact plates affixed to the interior surface of circumferential member, and each impact plate is disposed between the circumferential member and a corresponding internal pad, and the impact plates absorb or disperse trauma force applied to the head-gear; and, (d) the impact plates including a first impact plate and a second impact plate, each affixed to a corresponding side section of the circumferential member on the interior surface of the circumferential member and generally conforming to a shape of an ear, and not covering the aperture.

8. The device of claim 7 further wherein the plurality of impact plates includes a third impact plate position on the interior surface of the back section of the circumferential member.

9. The device of claim 7 wherein said circumferential member and internal pads are covered with a polyvinyl coating material.

10. The device of claim 7 further comprising a chin protector section composed of a foam material and integrally connected with the side sections of the circumferential member.

11. The device of claim 10 wherein the plurality of impact plates includes a fourth impact plate affixed to the interior surface of the circumferential member on the chin protector section, and the device further including an internal pad affixed to the circumferential member and covering the impact plate.

* * * * *